US012510072B2

(12) United States Patent
Zhao et al.

(10) Patent No.: US 12,510,072 B2
(45) Date of Patent: Dec. 30, 2025

(54) COMPRESSOR AND REFRIGERATION DEVICE

(71) Applicant: GUANGDONG MIDEA ENVIRONMENTAL TECHNOLOGIES CORPORATION LIMITED, Guangdong (CN)

(72) Inventors: Yuantie Zhao, Guangdong (CN); Xiaolei Li, Guangdong (CN); Bo Jiang, Guangdong (CN); Xijin Huang, Guangdong (CN); Junbo Liu, Guangdong (CN); Canyu Qian, Guangdong (CN); Baiying Huang, Guangdong (CN)

(73) Assignee: GUANGDONG MIDEA ENVIRONMENTAL TECHNOLOGIES CORPORATION LIMITED, Guangdong (CN)

( * ) Notice: Subject to any disclaimer, the term of this patent is extended or adjusted under 35 U.S.C. 154(b) by 55 days.

(21) Appl. No.: 17/744,021

(22) Filed: May 13, 2022

(65) Prior Publication Data

US 2022/0268278 A1 Aug. 25, 2022

Related U.S. Application Data

(63) Continuation of application No. PCT/CN2020/134999, filed on Dec. 9, 2020.

(30) Foreign Application Priority Data

Aug. 31, 2020 (CN) ..... 202010898242.2
Aug. 31, 2020 (CN) ..... 202021862555.4

(51) Int. Cl.
*F04C 18/02* (2006.01)

(52) U.S. Cl.
CPC .... *F04C 18/0215* (2013.01); *F04C 2230/603* (2013.01); *F04C 2240/30* (2013.01)

(58) Field of Classification Search
CPC .... F04C 18/0207–0292; F04C 2240/30; F04C 27/005; F04C 29/0021; F04C 2240/805
See application file for complete search history.

(56) References Cited

U.S. PATENT DOCUMENTS

2007/0231172 A1* 10/2007 Fujimura ..... F04C 18/0215 418/55.6
2013/0121866 A1 5/2013 Jang et al.
(Continued)

FOREIGN PATENT DOCUMENTS

CN 1095454 A 11/1994
CN 201830060 U 5/2011
(Continued)

OTHER PUBLICATIONS

Kupiec, Hailey, "Chamfer or Fillet: It's More Than a Coin Toss" Jul. 19, 2016, https://www.engineering.com/chamfer-or-fillet-its-more-than-a-coin-toss/ (Year: 2016).*
(Continued)

*Primary Examiner* — Mark A Laurenzi
*Assistant Examiner* — Xiaoting Hu
(74) *Attorney, Agent, or Firm* — Scully, Scott, Murphy & Presser, P.C.

(57) ABSTRACT

A compressor and a refrigeration device are provided. The compressor has a casing and a main frame disposed in the casing. The main frame has a guide structure configured to position the main frame. By coordination between the guide structure and a tooling, the process for positioning the main frame can be effectively simplified, the efficiency of positioning the main frame can be improved, and the assembly operation by workers can be facilitated.

10 Claims, 2 Drawing Sheets

(56) References Cited

U.S. PATENT DOCUMENTS

| | | | | |
|---|---|---|---|---|
| 2013/0177465 | A1* | 7/2013 | Clendenin | F04C 18/0215 384/420 |
| 2015/0152868 | A1* | 6/2015 | Fu | F04C 29/0021 418/55.5 |
| 2016/0312780 | A1* | 10/2016 | Seibel | F04C 23/008 |
| 2020/0224659 | A1* | 7/2020 | Yoo | F04C 29/0042 |
| 2020/0284257 | A1* | 9/2020 | Park | F04C 23/008 |
| 2022/0316478 | A1* | 10/2022 | Zhang | F04C 29/02 |
| 2022/0372976 | A1* | 11/2022 | Zhang | F04C 18/0215 |

FOREIGN PATENT DOCUMENTS

| | | | | |
|---|---|---|---|---|
| CN | 201874815 | U | | 6/2011 |
| CN | 202360393 | U | | 8/2012 |
| CN | 202431518 | U | | 9/2012 |
| CN | 202579197 | U | | 12/2012 |
| CN | 103104486 | A | | 5/2013 |
| CN | 105370569 | A | | 3/2016 |
| CN | 207634304 | U | * | 7/2018 |
| CN | 108603502 | A | | 9/2018 |
| CN | 111878392 | A | | 11/2020 |
| CN | 212407022 | U | | 1/2021 |
| JP | H06317267 | A | * | 11/1994 |
| JP | 2018141427 | A | | 9/2018 |

OTHER PUBLICATIONS

International Search Report dated May 26, 2021 received in International Patent Application No. PCT/CN2020/134999 together with an English language translation.

First Office Action dated Dec. 2, 2024 received in Chinese patent Application No. 202010898242.2.

Second Office Action dated Feb. 28, 2025 for Chinese Patent Application No. 202010898242.2.

Supplementary search dated May 30, 2025 received in Chinese Patent Application No. 202010898242.2.

* cited by examiner

COMPRESSOR AND REFRIGERATION DEVICE

CROSS-REFERENCE TO RELATED APPLICATIONS

This application is a continuation application of PCT International Patent Application No. PCT/CN2020/134999, filed on Dec. 9, 2020, which claims priority to and benefits of Chinese Patent Application No. 202010898242.2 filed on Aug. 31, 2020 and Chinese Patent Application No. 202021862555.4 filed on Aug. 31, 2020, the entire contents of which are incorporated herein by reference for all purposes. No new matter has been introduced.

FIELD

The present disclosure relates to the field of compressors, and in particular, to a compressor and a refrigeration device.

BACKGROUND

A main frame, as a main structure of a compressor, is fixed on the inner wall surface of the casing of the compressor, and can be configured to support a vortex movable disk and to fix a vortex static disk. Therefore, the requirement for the positioning accuracy of the main frame is extremely high for the compressor.

In related art, an axial displacement of the main frame in a welding process is locked and limited by bolt holes in the main frame, and the inner cylindrical holes of the main frame cooperate with a tooling to limit a radial displacement of the main frame. According to this positioning method, both peripheral threads and the inner cylindrical holes need to satisfy the tooling, and workers need to operate and adjust for many times, which renders a low work efficiency and seriously affects the production efficiency of the compressor.

SUMMARY

The present application aims to solve at least one of the technical problems in the prior art.

Thus, according to a first aspect of the present application, a compressor is provided.

According to a second aspect of the present application, a refrigeration device is provided.

According to the first aspect of the present application, a compressor is provided. The compressor comprises a casing and a main frame disposed in the casing. The main frame comprises a guide structure, and the guide structure is configured to position the main frame.

The compressor provided by the present application comprises the casing and the main frame. The main frame is disposed in the casing and can be connected to the inner wall of the casing by welding or other connecting methods. The main frame comprises the guide structure, and the guide structure can be used in conjunction with a tooling to further accomplish the positioning and mounting of the main frame.

The requirement for the positioning accuracy of the main frame is extremely high for the compressor. During the assembly process of the compressor provided in the present application, the tooling extends into the interior of the guide structure. The tooling itself is a retractable structure that can be driven by a hydraulic method or the like. When the tooling extends into the interior of the guide structure, the tooling is driven to unfold, and at this moment, the tooling is closely attached to the inner wall of the guide structure.

Accurate positioning of the main frame is achieved by means of the cooperation between the tooling and the guide structure. Thus, the accurate positioning of the main frame inside the casing is ensured, an assembly accuracy of the compressor is ensured, and the relative position stability of the main frame and the inner wall of the casing is ensured, and workers can conduct subsequent mounting work.

In addition, due to the good cooperation between the tooling and the guide structure, the workers can realize the positioning of the main frame through only one operation, and therefore, the technical process is simple, which can greatly improve the production efficiency of the compressor, and further reduce the costs of the compressor. In other words, according to the compressor provided by the present application, by means of the cooperation between the guide structure and the tooling, the process for positioning the main frame can be effectively simplified, the efficiency of positioning the main frame is improved, and the assembly operation of workers is facilitated.

According to the above embodiment of the present application, the compressor can further comprise the following additional technical features.

In the above embodiment, the main frame further comprises a body. The guide structure comprises a guiding cavity disposed in the body. An end of the guiding cavity is open. The guide structure further comprises a centering cavity disposed in the body and communicating with the guiding cavity.

In this exemplary embodiment, the main frame further comprises the body, and the guide structure comprises the guiding cavity and the centering cavity. The body serves as a main body structure of the main frame, and the guiding cavity and the centering cavity are both disposed in the body. For example, the guiding cavity is provided in the upper end face of the body, and an end of the guiding cavity is open; and the centering cavity is disposed in the middle portion of the body and the centering cavity is in communication with the guiding cavity. During the assembly process of the compressor, the tooling is in a contracted state initially, and the tooling in the contracted state enters the inside of the centering cavity through the guiding cavity; and subsequently, the tooling is in an unfolded state, and the tooling in the unfolded state is closely attached to the inner wall of the centering cavity, which ensures a stable connection between the tooling and the main frame, and at the same time ensures an accurate positioning of the main frame.

Particularly, the above-mentioned operating process is simple, and can be accomplished through one operation of entering the tooling into the interior of the centering cavity through the guiding cavity and controlling the tooling to contract or unfold. In addition, the guiding cavity and the centering cavity are disposed inside the body of the main frame, and do not have any requirement for the external dimension of the main frame, and thus can be applied to main frames of different specifications and dimensions, and thus are of high universality, which is conducive to the serialized design of compressor products.

In any one of the above embodiments, the centering cavity comprises: a first sub-cavity disposed in the body and communicating with the guiding cavity; and a second sub-cavity disposed between the guiding cavity and the first sub-cavity. The inner wall of the second sub-cavity is set inclined.

In the above embodiment, the centering cavity comprises a first sub-cavity and a second sub-cavity. The first sub-cavity is located inside the body; the second sub-cavity is located between the guiding cavity and the first sub-cavity;

the first sub-cavity communicates with the guiding cavity through the second sub-cavity. Thus, it can be ensured that the tooling can enter the interior of a first sub-cavity through the guiding cavity. In addition, the inner wall of the second sub-cavity is set inclined, and the dimension of the end of the second sub-cavity which is connected with the first sub-cavity is greater than that of the end of the second sub-cavity which is connected with the guiding cavity, so that the inner wall of the second sub-cavity forms an inclined surface, and the second sub-cavity with the inclined inner wall can have good guiding and centering function, which assists the operation of workers.

In any one of the above embodiments, the compressor further comprises a rotating shaft disposed in the casing, and a first vortex disk connected with the rotating shaft and supported on the main frame. The guiding cavity and the centering cavity are distributed along an axis direction of the rotating shaft.

In this exemplary embodiment, the compressor further comprises the rotating shaft and the first vortex disk. The rotating shaft is disposed inside the casing and extends along the height direction of the casing. The guiding cavity and the centering cavity are distributed along the axis direction of the rotating shaft; the guiding cavity is located above the centering cavity; and the guiding cavity and the centering cavity are distributed in a vertical direction. In addition, the first vortex disk is connected with the rotating shaft, and can perform a gyratory motion under the driving of the rotating shaft and subsequently cooperate with other structures to compress mediums of the compressor. For example, the first vortex disk contacts the upper end face of the main frame, and is supported through the upper end face of the main frame, and thus the stability of the internal structure of the casing is ensured.

In other words, inside the casing, the rotating shaft goes through the main frame and is connected with the first vortex disk; the first vortex disk directly contacts the upper end face of the main frame and is supported through the upper end face of main frame.

In any one of the above embodiments, a straight line where a bus of the inner wall of the second sub-cavity is located forms an included angle with an axis of the rotating shaft, and the included angle is greater than or equal to 5°.

In this exemplary embodiment, the straight line where the bus of the inner wall of the second sub-cavity is located forms an included angle with the axis of the rotating shaft, and the included angle is also regarded as an inclination degree of the inner wall of the second sub-cavity, and is greater than or equal to 5°. On the one hand, the coordination of the internal structures of the body of the main frame is ensured, especially the coordination of the structures at the transition portion between the first sub-cavity and the guiding cavity is ensured, and on the other hand, the inclined surface of the above-mentioned degree of inclination can ensure that the second sub-cavity has good guiding and positioning effect, which assists the entrance and removal of the tooling, and assists the positioning of the main frame at the same time.

In any one of the above embodiments, the main frame is sectioned along a direction perpendicular to the axis of the rotating shaft, and an area of a cross section of the guiding cavity is smaller than an area of a cross section of the first sub-cavity.

In this exemplary embodiment, the main frame is sectioned along a direction perpendicular to the axis of the rotating shaft, and subsequently a first cross section is taken in the guiding cavity and a second cross section is taken in the first sub-cavity. For example, the area of the first cross section is smaller than that of the second cross section. That is, the radial dimension of the first sub-cavity is larger than that of the guiding cavity, or the lateral dimension of the first sub-cavity is larger than that of the guiding cavity, so as to ensure that there is enough space in the first sub-cavity for the cooperation of the use of the tooling, especially for the cooperation of the work of the unfolded tooling, and the positioning stability of the main frame is further improved.

For example, the tooling is in a contracted state before entering the centering cavity, and subsequently switches to an unfolded state after entering the centering cavity. Therefore, the area of the cross section of the guiding cavity is disposed smaller than the area of the cross section of the first sub-cavity, which not only ensures that the tooling in the contracted state can enter the interior of the centering cavity smoothly, but also plays a certain role of limiting the tooling in the unfolded state inside the centering cavity, and further improves the stability of the main frame during the process of positioning and assembling.

In any one of the above embodiments, the main frame further comprises a support structure disposed on the body and located at a periphery of the guide structure. The support structure and the guiding cavity are coaxially disposed.

In this exemplary embodiment, the main frame further comprises the support structure. Similar to the guide structure, the support structure and the guide structure are both disposed on the body of the main frame. The difference is that the guide structure is distributed at the middle portion of the body while the support structure is distributed at the periphery of the guide structure along the radial direction of the main frame, which ensures the universality of the guide structure while ensuring reasonable positions of the support structure and the guide structure. For example, in the assembly process of the main frame, the main frame can be placed inside the casing through the support structure and supported by the support structure, and thus the stability of the structure of the main frame is ensured and the operation of the workers is facilitated.

Furthermore, the support structure and the guiding cavity are coaxially disposed, so that the design of the structure of the main frame is more reasonable, and meanwhile it is ensured that the tooling can be used in cooperation with the middle position of the main frame, which facilities users to adjust the position of the main frame.

In any one of the above embodiments, the compressor further comprises a second vortex disk disposed in the casing. The first vortex disk and the second vortex disk each comprise a substrate and scroll teeth. The scroll teeth are disposed on the substrate. The first vortex disk and the second vortex disk jointly form a plurality of compression chambers.

In this embodiment, the compressor further comprises the second vortex disk. Similar to the first vortex disk, the second vortex disk and the first vortex disk are both disposed inside the casing, and the second vortex disk can cooperate with the first vortex disk to compress mediums. For example, both of the first vortex disk and the second vortex disk comprise a substrate and scroll teeth, and the scroll teeth are disposed between two substrates, so that the first vortex disk and the second vortex disk jointly form a plurality of compression chambers. During the operation of the compressor, the rotating shaft drives the first vortex disk to perform a gyratory motion, so that the first vortex disk cooperates with the second vortex disk to compress the mediums of the compressor.

For example, the first vortex disk is a movable vortex disk; the second vortex disk is a static vortex disk; the first vortex disk is connected with the rotating shaft; and the second vortex disk is disposed above the first vortex disk.

In any one of the above embodiments, the plurality of compression chambers comprise: a suction chamber, being formed between the first vortex disk and the second vortex disk; a discharge chamber, being formed between the first vortex disk and the second vortex disk; and an intermediate pressure chamber, communicating with the suction chamber and the discharge chamber.

In this exemplary embodiment, the plurality of compression chambers comprise the suction chamber, the intermediate pressure chamber and the discharge chamber. The intermediate pressure chamber is formed between the suction chamber and the discharge chamber and communicates with the suction chamber and the discharge chamber at the same time. During the operation of the compressor, the suction chamber suctions the mediums, subsequently the mediums in the suction chamber enter the intermediate pressure chamber so as to be compressed, and the compressed mediums enter the interior of the discharge chamber and finally are discharged out of the compressor.

In any one of the above embodiments, the compressor provided by the present application can be a scroll compressor.

According to a second aspect of the present application, a refrigeration device is provided, and the refrigeration device comprises a compressor according to any one of the above embodiments.

The refrigeration device provided by the present application comprises the compressor according to any one of the above embodiments. Therefore, the refrigeration device possesses all the beneficial effects of the above-mentioned compressor and will not be repeated herein.

The refrigeration device provided by the present application comprises, but is not limited to, air conditioners, refrigerators, freezers, display cabinets and etc.

The additional aspects and advantages of the present application will be obvious in the following description, or can be understood through the implementation of the present application.

BRIEF DESCRIPTION OF THE DRAWINGS

The above and/or additional aspects and advantages of the present application will be obvious and understandable from the following description of the embodiments in combination with the accompanying drawings.

The corresponding relations between the reference signs in FIGS. 1-3 and the names of the components are as follows:

102 casing; 104 main frame; 1042 guide structure; 1044 guiding cavity; 1046 centering cavity; 1048 first sub-cavity; 1050 second sub-cavity; 1052 inner wall; 1054 support structure; 1056 body; 106 rotating shaft; 108 first vortex disk; 110 second vortex disk.

DETAILED DESCRIPTION OF EMBODIMENTS

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

Hereinafter, a compressor and a refrigeration device according to some embodiments of the present disclosure will be described with reference to FIGS. 1-3.

Figure 1:
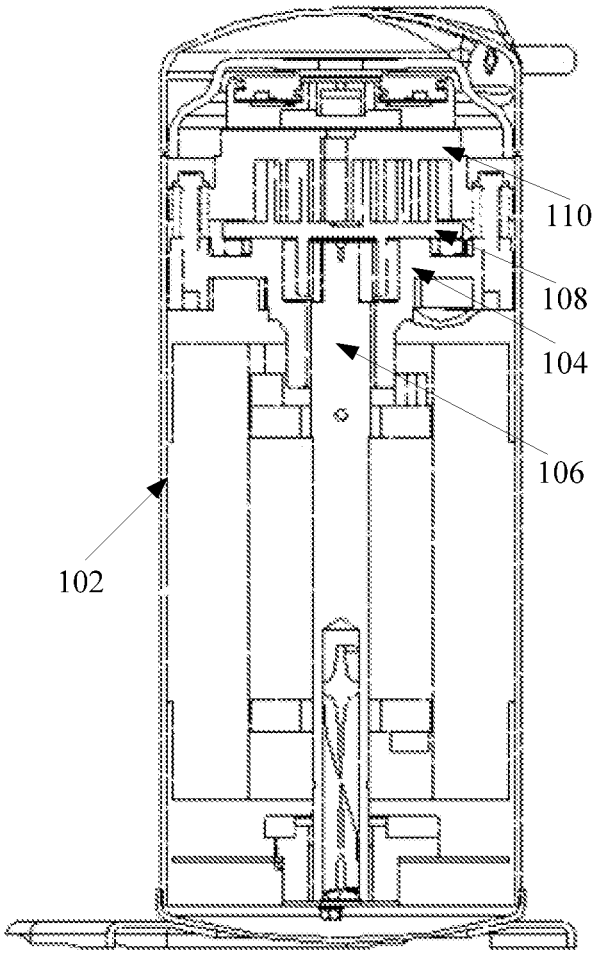
FIG. 1 is a schematic view of the structure of a compressor according to an embodiment of the present application.
Figure 2:
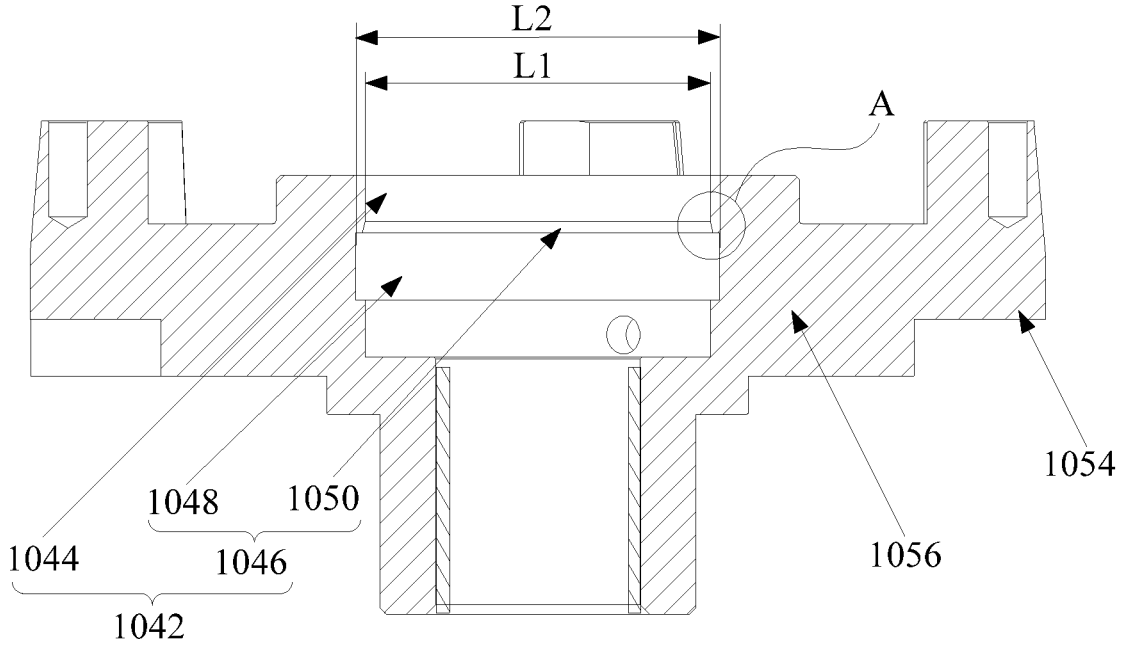
FIG. 2 is a sectional view of the main frame in the compressor according to the embodiment shown in FIG. 1.

As shown in FIG. 1 and FIG. 2, according to an exemplary embodiment of the present application, a compressor is provided. The compressor comprises a casing 102 and a main frame 104; and the main frame 104 comprises a guide structure 1042.

As shown in FIG. 1, the main frame 104 is disposed in the casing 102, and can be connected to the inner wall of the casing 102 by welding or other connecting methods. The guide structure 1042 can be used in conjunction with a tooling to further accomplish the positioning and mounting of the main frame 104.

The requirement for the positioning accuracy of the main frame 104 is extremely high for the compressor. During the assembly process of the compressor provided in the present application, the tooling extends into the interior of the guide structure 1042. The tooling itself is a retractable structure that can be driven by a hydraulic method or the like. When the tooling extends into the interior of the guide structure 1042, the tooling is driven to unfold, and at this moment, the tooling is closely attached to the inner wall of the guide structure 1042. Accurate positioning of the main frame 104 is achieved by means of the cooperation between the tooling and the guide structure 1042. Thus, the accurate position of the main frame 104 inside the casing 102 is ensured, and the relative position stability of the main frame 104 and the inner wall of the casing 102 is ensured, and workers can conduct subsequent mounting work.

In addition, due to the good cooperation between the tooling and the guide structure 1042, the workers can realize the positioning of the main frame 104 through only one operation, and therefore, the technical process is simplified, which can greatly improve the production efficiency of the compressor, and further reduce the costs of the compressor.

In other words, according to the compressor provided by the exemplary embodiment, by means of the cooperation between the guide structure 1042 and the tooling, the process for positioning the main frame 104 can be effectively simplified, the efficiency of positioning the main frame 104 is improved, and the assembly operation of workers is facilitated.

Figure 3:
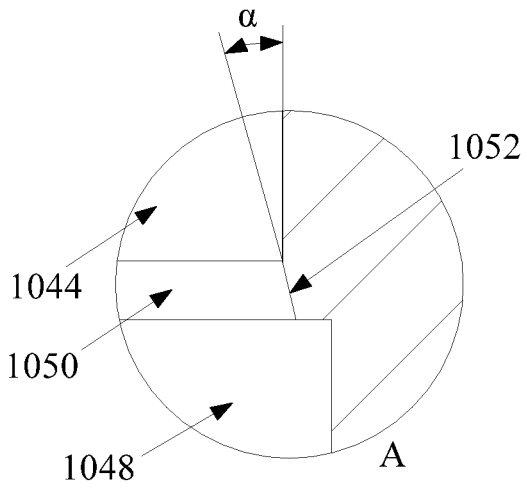
FIG. 3 is a partial enlargement view of a portion A of the sectional view according to the embodiment shown in FIG. 2.

As shown in FIGS. 1-3, according to another exemplary embodiment of the present application, a compressor is provided, and the compressor comprises a casing 102 and a main frame 104; the main frame 104 comprises a body 1056 and a guide structure 1042; and the guide structure 1042 comprises a guiding cavity 1044 and a centering cavity 1046.

As shown in FIG. 1, the main frame 104 is disposed in the casing 102, and can be connected to the inner wall of the casing 102 by welding or other connecting methods. The guide structure 1042 can be used in conjunction with a tooling to further accomplish the positioning and mounting for the main frame 104.

For example, as shown in FIG. 2, the guiding cavity 1044 is disposed in the upper end face of the body 1056, and an end of the guiding cavity 1044 is open; the centering cavity 1046 is disposed in the middle portion of the body 1056, and is in communication with the guiding cavity 1044. During the assembly process of the compressor, the tooling is in a contracted state at first, and the tooling in the contracted state enters the interior of the centering cavity 1046 through the guiding cavity 1044; and subsequently the tooling is in an unfolded state, and the tooling in the unfolded state is closely attached to the inner wall of the centering cavity 1046, which ensures a stable connection between the tooling and the main frame 104, and at the same time ensures accurate positioning of the main frame 104.

In addition, the above-mentioned operating process is simple, and can be accomplished through only one operation of entering the tooling into the interior of the centering cavity 1046 through the guiding cavity 1044 and controlling the tooling to contract or unfold. In addition, the guiding cavity 1044 and the centering cavity 1046 are disposed inside the body 1056 of the main frame 104, and do not have any requirement for the external dimension of the body 1056 of the main frame 104, and thus can be applied to the positioning of main frames 104 of different specifications and dimensions, and thus are of high universality, which are conducive to the serialized design of compressor products.

In the present embodiment, furthermore, as shown in FIG. 2, the centering cavity 1046 comprises a first sub-cavity 1048 and a second sub-cavity 1050. The first sub-cavity 1048 is located inside the body 1056; the second sub-cavity 1050 is located between the guiding cavity 1044 and the first sub-cavity 1048; the first sub-cavity 1048 communicates with the guiding cavity 1044 through the second sub-cavity 1050, and this ensures that the tooling can enter the interior of a first sub-cavity 1048 through the guiding cavity 1044.

In addition, the inner wall 1052 of the second sub-cavity 1050 is set inclined, and the dimension of the end of the second sub-cavity 1050 which is connected with the first sub-cavity 1048 is greater than that of the end of the second sub-cavity 1050 which is connected with the guiding cavity 1044, so that the inner wall 1052 of the second sub-cavity 1050 forms an inclined surface, and the second sub-cavity 1050 with the inclined inner wall 1052 can have good guiding and centering function, which assists the operation of workers.

In this exemplary embodiment, furthermore, as shown in FIG. 1, the compressor further comprises the rotating shaft 106 and a first vortex disk 108.

The rotating shaft 106 is disposed inside the casing 102 and extends along the height direction of the casing 102. The guiding cavity 1044 and the centering cavity 1046 are distributed along the axis direction of the rotating shaft 106; the guiding cavity 1044 is located above the centering cavity 1046; and the guiding cavity 1044 and the centering cavity 1046 are distributed in a vertical direction. In addition, the first vortex disk 108 is connected with the rotating shaft 106, and can perform a gyratory motion under the driving of the rotating shaft 106 and subsequently cooperate with other structures to compress mediums of the compressor. For example, the first vortex disk 108 contacts the upper end face of the main frame 104, and is supported through the upper end face of the main frame 104, and thus the stability of the internal structure of the casing 102 is ensured.

In the exemplary embodiment, as shown in FIG. 1, inside the casing 102, the rotating shaft 106 goes through the main frame 104 and is connected with the first vortex disk 108; the first vortex disk 108 directly contacts the upper end face of the main frame 104 and is supported through the upper end face of main frame 104.

In this exemplary embodiment, furthermore, as shown in FIG. 3, the straight line wherein the bus of the inner wall 1052 of the second sub-cavity 1050 is located forms an included angle $\alpha$ with the axis of the rotating shaft 106, and the included angle $\alpha$ is $\geq 5°$.

The straight line where the bus of the inner wall 1052 of the second sub-cavity 1050 is located forms an included angle $\alpha$ with the axis of the rotating shaft 106, and the included angle $\alpha$ is $\geq 5°$. On the one hand, the coordination of the internal structures of the body 1056 of the main frame 104 is ensured, especially the coordination of the structures at the transition portion between the first sub-cavity 1048 and the guiding cavity 1044 is ensured, and on the other hand, the inclined surface of the above-mentioned degree of inclination can ensure that the second sub-cavity 1050 has good guiding and positioning effect, which assists the entrance and removal of the tooling, and assists the positioning of the main frame 104 at the same time.

In this exemplary embodiment, furthermore, the main frame 104 is sectioned along a direction perpendicular to the axis of the rotating shaft 106, and subsequently a first cross section is taken in the guiding cavity 1044 and a second cross section is taken in the first sub-cavity 1048. The area of the first cross section is smaller than that of the second cross section.

In other words, the radial dimension of the first sub-cavity 1048 is larger than that of the guiding cavity 1044, or the lateral dimension of the first sub-cavity 1048 is larger than that of the guiding cavity 1044, so as to ensure that there is enough space in the first sub-cavity 1048 to cooperate with the use of the tooling, especially the operation of unfolded tooling, and the positioning stability of the main frame 104 is further improved.

In the exemplary embodiment, as shown in FIG. 2, it can be seen clearly from the sectional view of the main frame 104 that the radial dimension of the first sub-cavity 1048 is L2, and the radial dimension of the guiding cavity 1044 is L1, which satisfy L2>L1.

In the exemplary embodiment, the tooling is in a contracted state before entering the centering cavity 1046, and subsequently changes to an unfolded state after entering the centering cavity 1046. Therefore, the area of the cross section of the guiding cavity 1044 is disposed smaller than that of the cross section of the first sub-cavity 1048, which not only ensures that the tooling in the contracted state can enter the interior of the centering cavity 1046 smoothly, but also plays a certain role of limiting the tooling in the unfolded state inside the centering cavity 1046, and further improves the stability of the main frame 104 during the process of positioning and assembling.

In this embodiment, furthermore, as shown in FIG. 2, the main frame 104 further comprises the support structure 1054. Similar to the guide structure 1042, the support structure 1054 and the guide structure 1042 are both disposed on the body 1056 of the main frame 104. The difference is that the guide structure 1042 is distributed at the middle portion of the body 1056 while the support structure 1054 is distributed at the periphery of the guide structure 1042 along the radial direction of the main frame 104, which ensures the universality of the guide structure 1042 while ensuring reasonable positions of the support structure 1054 and the guide structure 1042.

In the exemplary embodiment, in the assembly process of the main frame 104, the main frame 104 can be placed inside the casing 102 through the support structure 1054 and supported by the support structure 1054, and thus the stability of the structure of the main frame 104 is ensured and the operation of the workers is facilitated.

In addition, as shown in FIG. 2, the support structure 1054 and the guiding cavity 1044 are coaxially disposed, so that the design of the structure of the main frame 104 is more reasonable, and meanwhile it is ensured that the tooling can be used in cooperation with the middle position of the main frame 104, which facilities users to adjust the position of the main frame 104.

As shown in FIGS. 1 and 2, according to still another exemplary embodiment of the present application, a compressor is provided, and the compressor comprises: a casing 102, a main frame 104, a rotating shaft 106, a first vortex disk 108 and a second vortex disk 110; and the main frame 104 comprises a guide structure 1042.

As shown in FIG. 1, the main frame 104 is disposed inside the casing 102, and can be connected to the inner wall of the casing 102 by welding or other connecting methods. The guide structure 1042 can be used in conjunction with a tooling to further accomplish the positioning and mounting for the main frame 104. The guide structure 1042 possesses the same beneficial effects as those in the previous embodiments, which will not be repeated herein.

In addition, as shown in FIG. 1, the rotating shaft 106 goes through the main frame 104 and is connected with the first vortex disk 108; the first vortex disk 108 is connected with the rotating shaft 106 and can perform a gyratory motion under the driving of the rotating shaft 106, and then cooperate with the second vortex disk 110 to compress mediums. In addition, the first vortex disk 108 directly contacts the upper end face of the main frame 104 and is supported through the upper end face of main frame 104.

For example, similar to the first vortex disk 108, the second vortex disk 110 and the first vortex disk 108 are both disposed inside the casing 102, and the second vortex disk 110 can cooperate with the first vortex disk 108 to compress mediums of the compressor. Furthermore, both the first vortex disk 108 and the second vortex disk 110 comprise a substrate and scroll teeth, and the scroll teeth are disposed between two substrates, so that the first vortex disk 108 and the second vortex disk 110 jointly form a plurality of compression chambers. During the operation of the compressor, the rotating shaft 106 drives the first vortex disk 108 to perform a gyratory motion, so that the first vortex disk 108 cooperates with the second vortex disk 110 to compress the mediums.

In the exemplary embodiment, the first vortex disk 108 is a movable vortex disk; the second vortex disk 110 is a static vortex disk; the first vortex disk 108 is connected with the rotating shaft 106; and the second vortex disk 110 is disposed above the first vortex disk 108.

In this exemplary embodiment, furthermore, a plurality of compression chambers comprise a suction chamber, an intermediate pressure chamber and a discharge chamber. The intermediate pressure chamber is formed between the suction chamber and the discharge chamber, and communicates with the suction chamber and the discharge chamber at the same time. During the operation of the compressor, the suction chamber suctions the mediums, subsequently the mediums in the suction chamber enter the intermediate pressure chamber so as to be compressed, and the compressed mediums enter the interior of the discharge chamber and finally are discharged out of the compressor.

According to the yet another embodiment of the present application, a refrigeration device is provided, and the refrigeration device comprises a compressor according to any one of the previous embodiments (this embodiment is not shown in the drawings).

The refrigeration device provided by the present application comprises the compressor according to any one of the above embodiments, and thus has all the beneficial effects of the compressors, which will not be repeated herein.

In any one of the above embodiments, the compressor is a scroll compressor.

In any one of the above embodiments, the refrigeration device comprises, but is not limited to, air conditioners, refrigerators, freezers, display cabinets and etc.

Exemplary Embodiment

As shown in FIGS. 1 and 2, the present exemplary embodiment provides a compressor and an assembling method thereof, and the compressor can be a scroll compressor. The compressor comprises a casing 102, an upper casing and a main frame 104, and the main frame 104 is combined to the inner side of the casing 102; the compressor further comprises a first vortex disk 108, and the first vortex disk 108 performs a gyratory motion through the rotation of the rotating shaft 106 and is supported by the main frame 104; the compressor further comprises a second vortex disk 110, the second vortex disk 110 is disposed at one side of the first vortex disk 108, and the second vortex disk 110 and the first vortex disk 108 jointly form a plurality of compression chambers. In addition, the main frame 104 comprises an external support structure 1054 and an internal guide structure 1042, and the guide structure 1042 can be used to fix and position the main frame 104, which is conducive to the assembly of the compressor.

According to this exemplary embodiment provided by the present embodiment, through accurately positioning the main frame 104, the assembly accuracy of the compressor can be ensured, and meanwhile the structure is of high universality, which is convenient for the serialization of compressors and improves the automation efficiency of production lines.

For example, as shown in FIG. 1, the compressor provided in the present exemplary embodiment comprises a first vortex disk 108 and a second vortex disk 110. The first vortex disk 108 comprises a substrate and scroll teeth connected with the substrate. The second vortex disk 110 and the first vortex disk 108 jointly form a suction chamber, an intermediate pressure chamber and a discharge chamber. The compressor further comprises a main frame 104, as shown in FIG. 2. The main frame 104 is disposed under the first vortex disk 108 and the second vortex disk 110, and directly contacts the first vortex disk 108. The compressor additionally comprises a guide structure 1042 disposed inside the main frame 104. The guide structure 1042 comprises a guiding cavity 1044 and a centering cavity 1046. The guiding cavity 1044 and the centering cavity 1046 are arranged along the axis direction of the rotating shaft 106.

Furthermore, as shown in FIG. 2, the guiding cavity 1044 extends to a central end face, and the outer diameters of the guiding cavity 1044 and the support structure 1054 of the main frame 104 are concentrically disposed. The centering cavity 1046 comprises a first sub-cavity 1048 and a second sub-cavity 1050, and the inner wall 1052 of the second sub-cavity 1050 is set inclined. The guiding cavity 1044 and the centering cavity 1046 of the main frame 104 are arranged sequentially in an axial direction; the guiding cavity 1044 extends axially and is connected with the centering cavity 1046; and the inner wall 1052 of the second sub-cavity 1050 is located between the first sub-cavity 1048 and the guiding cavity 1044. As shown in FIG. 3, the inner wall 1052 of the second sub-cavity 1050 has an inclined portion, and the included angle $\alpha$ between the straight line of the bus of the inner wall 1052 of the second sub-cavity 1050 and the straight line of the central axis is greater than 5°. As shown in FIG. 2, the radial dimension L1 of the guiding cavity 1044 is smaller than the radial dimension of the centering cavity 1046, and the radial dimension L2 of the first sub-cavity 1048 is the largest, which is used for accommodating the assembly of the tooling.

It needs multiple processes of assembling multiple combined components to accomplish a traditional process for positioning the main frame. Compared with the traditional process for positioning the main frame, the positioning of the main frame 104 of the present exemplary embodiment can be accomplished through one positioning process, and therefore the assembly of the process is simple, and the production efficiency of the compressor can be improved. The main frame 104 is positioned by the second sub-cavity 1050 which has the inclined inner wall 1052, the dimension of the inner cylindrical holes of the main frame 104 is easily ensured, and thus high positioning accuracy is realized, the assembly accuracy of the whole machine is improved, and then the coaxiality of the whole compressor and the reliability of the compressor are improved. In addition, this process structure does not affect other dimensions of the main frame 104 and assists the serialized design of compressor products.

In the exemplary embodiment, the compressor provided by the present embodiment is a scroll compressor, and the scroll compressor comprises a movable vortex disk with scroll teeth and a static vortex disk with scroll teeth. The movable vortex disk performs an orbiting motion relative to the static vortex disk. When the movable vortex disk and the static vortex disk are engaged with each other, as the movable vortex disk performs the orbiting motion, the capacity of the pressure chamber formed between the movable vortex disk and the static vortex disk is reduced. Therefore, the pressure of the mediums in the pressure chamber can be increased, and the mediums are discharged through a discharge port formed in the central portion of the static vortex disk.

A back-pressure regulating chamber is formed in the static vortex disk, and the back-pressure regulating chamber has a back-pressure chamber face of an intermediate pressure between a discharge pressure and a suction pressure. In other words, through the back-pressure regulating chamber, the movable vortex disk and the static vortex disk can contact each other by an appropriate force, which can prevent the refrigerant leakage and increase the lubrication, and at the same time, the contact force can be adjusted, the friction of the contact can be reduced, while a sealing force is not reduced.

In the present application, the term of "multiple" refers to two or more, unless otherwise clearly defined, the orientation or positional relationships indicated by the terms "upper", "lower" and the like are based on the orientation or positional relationships shown in the drawings, and are only intended for the convenience of describing the present application and simplifying the description, rather than indicating or implying that the indicated devices or elements must have specific orientations or must be constructed and operated in specific orientations, and therefore they should not be understood as limitations to the present application. The terms "mounting", "connected to", "connected with", "fix" and the like should be understood in a broad sense, for example, the term "connected with" can be a fixed connection, a detachable connection, or an integral connection; the term "connected to" can be a direct connection or an indirect connection through an intermediate medium. For those skilled in the art, they may understand the specific meanings of the above-mentioned terms in the present disclosure according to specific circumstances.

In the specification of the present application, the description by the terms of "an embodiment", "some embodiments", "specific embodiment" and the like means that the specific features, structures, materials or characteristics described in combination with the embodiments or examples are contained in at least one embodiment or example of the present application. In the specification, the illustrative expressions of the above terms may not indicate the same embodiments or examples. In addition, the specific features, structures, materials or characteristics as described may be combined in an appropriate method in one or more of any embodiments or examples.

The above-mentioned are merely some preferred embodiments of the present disclosure and not intended to limit the present application, and for one skilled in the art, various modifications and changes may be made to the present application. Any modifications, equivalent substitutions, improvements and so on made within the spirit and principle of the present application should be covered within the scope of protection of the present disclosure.

What is claimed is:

1. A compressor comprising:

a casing;

a main frame disposed in the casing, wherein the main frame comprises a guide structure to position and fix the main frame in an inner wall of the casing, the guide structure comprising:

a guiding cavity, wherein the guiding cavity is disposed in a body of the main frame and an end of the guiding cavity is open; and a centering cavity, wherein the centering cavity is disposed in the body of the main frame and communicates with the guiding cavity, wherein the centering cavity comprises:

a first sub-cavity, being disposed in the body of the main frame and communicating with the guiding cavity; and a second sub-cavity, being disposed between the guiding cavity and the first sub-cavity; and a rotating shaft, being disposed in the casing, wherein the guiding cavity and the centering cavity are distributed along an axis of the rotating shaft, wherein an inner wall of the second sub-cavity forms a frustoconical shape oriented with the axis of the rotating shaft, wherein an end of the inner wall of the second sub-cavity meets an inner wall of the first sub-cavity extending along a direction perpendicular to the axis of the rotating shaft, wherein the main frame further comprises a support structure, being disposed on the body of the main frame and located at a periphery of the guide structure, and wherein the support structure and the guiding cavity are coaxially disposed, wherein the guide structure further comprises a relief cavity on an opposite side of the centering cavity to the guiding cavity, and a transition between the first sub-cavity of the centering cavity and the relief cavity forms a right angle.

2. The compressor according to claim 1, further comprising a first vortex disk, being connected with the rotating shaft and supported on the main frame.

3. The compressor according to claim 2, further comprising:

a second vortex disk, being disposed in the casing, wherein both of the first vortex disk and the second vortex disk comprise a substrate and scroll teeth, the scroll teeth are disposed on the substrate, and the first vortex disk and the second vortex disk jointly form a plurality of compression chambers.

4. The compressor according to claim 3, wherein the plurality of compression chambers comprise:

a suction chamber, being formed between the first vortex disk and the second vortex disk;

a discharge chamber, being formed between the first vortex disk and the second vortex disk; and an intermediate pressure chamber, communicating with the suction chamber and the discharge chamber.

5. The compressor according to claim 1, wherein:

the main frame is sectioned along the direction perpendicular to the axis of the rotating shaft; and an area of a cross section of the guiding cavity is smaller than an area of the cross section of the first sub-cavity.

6. A refrigeration device comprising the compressor according to claim 1.

7. The compressor according to claim 1, wherein an outer wall of the support structure is inclined such that a gap is formed between the support structure and the casing.

8. The compressor according to claim 1, wherein the inner wall of the second sub-cavity has a maximum diameter less than a diameter of the centering cavity.

9. The compressor according to claim 1, wherein an outer wall of the support structure is set inclined relative to the axis of the rotating shaft.

10. A method comprising:

assembling the compressor according to claim 1, wherein the assembling comprises:

inserting a tooling in a contracted state through the guiding cavity into the centering cavity of the guide structure of the main frame;

expanding the tooling within the centering cavity to interface with the inner wall of the second sub-cavity that forms the frustoconical shape oriented with the axis of the rotating shaft to center the tooling with respect to the main frame;

using the tooling and the support structure, which are coaxially disposed, to center a position of the main frame with respect to the casing, and disposing the main frame inside the casing; and connecting the main frame to the inner wall of the casing.

* * * * *